United States Patent [19]

Bogda et al.

[11] Patent Number: 4,983,790

[45] Date of Patent: Jan. 8, 1991

[54] ELECTROMECHANICAL PROGRAMMER ASSEMBLY

[75] Inventors: Richard C. Bogda, Elmhurst; George D. Georgacakis, Skokie, both of Ill.

[73] Assignee: Eaton Corporation, Cleveland, Ohio

[21] Appl. No.: 386,371

[22] Filed: Jul. 28, 1989

[51] Int. Cl.[5] ..... H01H 43/10

[52] U.S. Cl. ..... 200/30 R; 200/38 B

[58] Field of Search ..... 200/38 R, 38 A, 38 B, 200/38 F, 38 FA, 38 BA, 38 C; 368/97, 107-109

[56] References Cited

U.S. PATENT DOCUMENTS 4,242,746 12/1980 Schuder et al. ..... 200/38 R
4,497,985 2/1985 Courter et al. ..... 200/38 B
4,497,986 2/1985 Zink et al. ..... 200/38 A
4,560,846 12/1985 Klodp et al. ..... 200/38 R
4,796,484 7/1989 Eder ..... 200/38 R

*Primary Examiner*—Vit W. Miska
*Attorney, Agent, or Firm*—R. A. Johnston

[57] ABSTRACT

An electromechanical programmer assembly for controlling electrically operated appliances having a rotatable cam drum operable upon motorized advancement to actuate and deactuate plural program switches for controlling appliance functions. A user actuated shaft is rotated to select the desired cam drum position for program selection. Axial movement of the shaft causes a cam thereon to lift a slider for opening a line power switch for controlling the motorized cam drive and engaging a friction detent on the cam drum for resisting rotation of the drum and to provide a tactilely sensed position indication to the user. Axial movement of the shaft to effect dropping of the slider closes the line power switch and disengages the detent.

14 Claims, 2 Drawing Sheets

ELECTROMECHANICAL PROGRAMMER ASSEMBLY

FIELD OF THE INVENTION

The present invention relates to electromechanical programmer/timers of the type having a rotary cam drum advanced by a motorized advance mechanism for controlling actuation and deactuation of a plurality of electrical switches. Programmers of this type are commonly employed in household appliances such as clothes washing machines, dryers and dishwashers for providing, upon user positioning of the cam drum, a selected timed program cycle for sequentially controlling the various machine functions through the cam-actuated switches.

In designing programmers of the aforementioned type, it has been found convenient to incorporate a rotary knob or actuator on the cam drum shaft for user positioning of the cam drum for program selection. It has also been found convenient to provide for axial movement of the selector knob for providing actuation and deactuation of a line power switch for controlling all machine functions and the motorized cam advance mechanism. In combining the functions of the user control knob of the programmer timer for operating the line switch and also rotatably positioning the cam drum for program selection, it has been found difficult to provide such a convenience without permitting the cam drum to be inadvertently rotated during a time when the line switch is in the closed condition. Cam drum rotation by the user rapidly sequentially operates the program switches and with line power applied thereto can result in damage to the appliance control functions. it has been desired to provide a programmer/timer with a selector knob which permits user rotatable positioning of the cam drum for program selection and also provides for axial movement of the selector knob or shaft for line power switch operation, yet prevents user rotation of the cam drum when the line power switch is in the ON condition.

It has further been desired to provide the aforementioned type of operation of an electromechanical programmer timer for appliance applications and to provide such a device with rotary positioning of the selector knob for selecting the machine program and to provide such a device with an indication of the OFF position of the program switches and one that is capable of being manufactured in high volume production at minimal cost.

SUMMARY OF THE INVENTION:

The present invention provides a unique electromechanical programmer/timer assembly for appliances incorporating a rotary cam drum with a plurality of cam tracks thereon for actuating individual switches for controlling appliance functions in response to motorized timed advancement of the cam drum. The cam drum is initially positioned by user rotation of a selector knob attached to a shaft disposed concentrically with the drum for positioning the cam drum for cycle or program selections.

The selector knob is also axially movable for push-/pull actuation of a separate line power switch for connecting line power to the function switches and to the motorized cam advance mechanism. A separate switch cam is provided on the selector knob cam shaft for de-actuating the line power switch when the selector knob has been pushed. A spring loaded detent mechanism is carried by the line power switch actuator and engages a detent on the cam drum when the line power switch is in the open position to permit rotation of the cam drum to a selected position by user tactile sensing of the selector knob position. The selector knob mechanism of the present programmer disengages the detent from the cam drum when the selector knob has been actuated to the condition for closing the line power switch.

The present invention thus provides a unique electromechanical programmer assembly for an appliance having a push/pull knob for actuating a line power switch. The knob is also operable to permit rotary positioning of the cam drum and includes a spring loaded detent operable only in the line switch OFF mode for providing a tactilely sensed indication of a selected program cam position.

BRIEF DESCRIPTION OF THE DRAWINGS:

FIG. 2 left side view of the embodiment of FIG. 1; showing the

Figure 1:
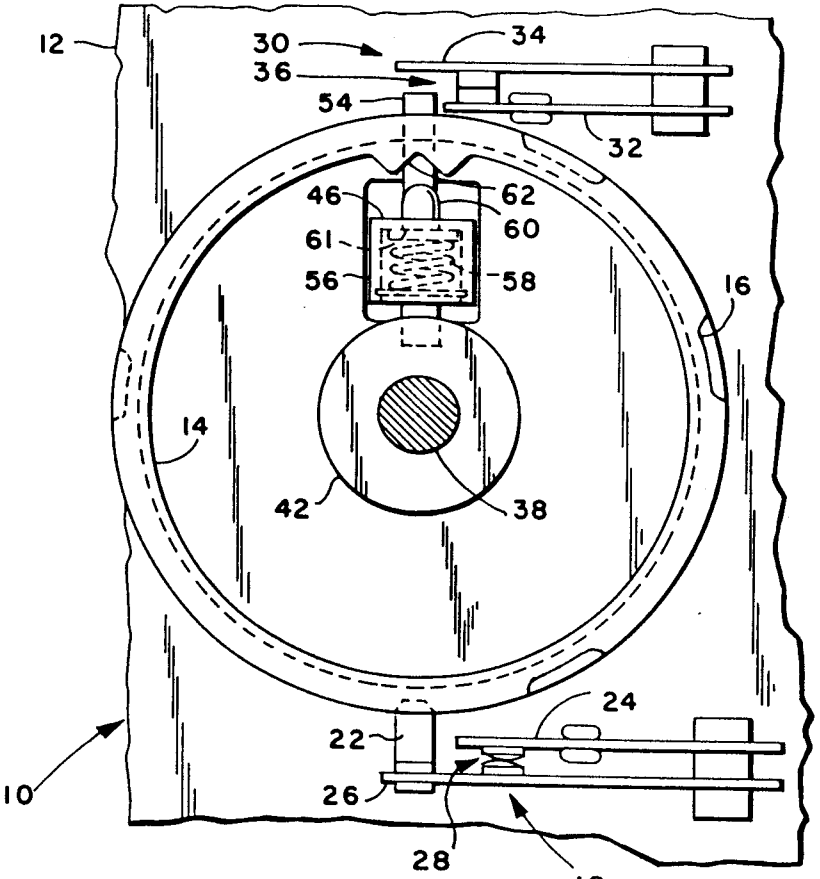
FIG. 1 a side elevation view of a portion of the programmer assembly of the present invention with the housing removed and the cam advance mechananism omitted.

DETAILED DESCRIPTION:

Referring to FIG. 1, the programmer assembly is indicated generally at 10 and has a base or housing a portion of which is shown at 12 and includes a rotatable cam drum 14 journaled for rotation on a portion housing which portion of the housing has been omitted in the drawings for simplicity. The cam drum 14 has at least one and preferably a plurality of cam tracks provided about the periphery thereof, one of which is denoted by reference numeral 16 in FIG. 1.

Figure 2:
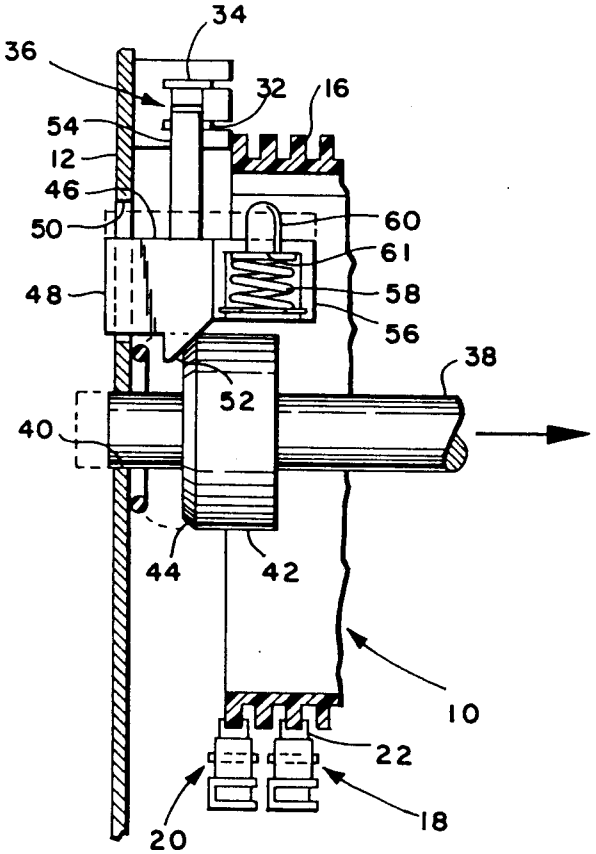

Referring to FIGS. 1 and 2, a plurality of program function switches indicated generally by reference numerals 18, 20 are disposed to each be actuated by one of the cam tracks by a cam follower such as follower 22 which contacts the cam track 16. Switch 18 as shown in FIG. 1 has a stationary blade 24 and a movable blade 26 which has on the free end thereof the cam follower 22 attached thereto. The switch 18 has a set of electrical contacts indicated generally at 28 which contacts are individually attached to the blades 24 26 for opening and closing in response to movement of blade 26 by cam follower 22.

A line power switch indicated generally at 30 is disposed on the housing 12 and has a stationary blade 32 and a movable blade 34 with a set of electrical contacts indicated generally at 36 disposed therebetween with the contacts each respectively attached to one of the blades. The line switch is adapted for connection to the power line and in series with a motorized advance (not shown) for advancing cam drum 14 and for series connection with the switches 18,20. Switch 30 is actuated in a manner as will hereinafter be described in further detail.

A shaft 38 is disposed concentrically with the drum 14 and has one end journaled through aperture 40 in housing 12 for rotation; and the other end of shaft 38 is journaled on portions of the housing not shown. The shaft 38 is also axially movable in the housing 12 upon user manipulation of a knob (not shown) but attached thereto on the right-hand end thereof.

Shaft 38 has an annular collar 42 provided thereon which collar is chamfered to provide a conically tapered camming surface 44.

A cam following means comprising member 46 has a portion 48 thereof slidably received in a slot 50 provided in housing 12; and, member 46 is guided therein for movement in a direction generally radially with respect to the drum 14. Sliding member 46 has a cam following surface 52 oriented to be slidably contacted by the cam surface 44 upon axial movement of the shaft 8. In addition, member 46 also has a switch actuating portion 54 formed thereon preferably integrally therewith and extending upwardly in a direction generally radially with respect to the drum 14.

Member 46 also has a hollow cage portion 56 formed preferably integrally therewith which cage portion has a spring 58 received therein. Spring 58 urges a sliding detent member 60 in an upward direction. Detent member 60 has a retaining portion 61 disposed within cage 56; and portion 61 is urged upwardly to register against the wall of the cage 56. The detent 60 is thus movable with the sliding member 46. With reference to FIGS. 1 and 2, shaft 38 is shown in its rightwardmost position in solid outline; and, the leftmost position is indicated in dashed outline. The position shown in solid outline is obtained by user movement of the knob (not shown) attached to shaft 38 in the axially rightward direction with respect to FIG. 2. In this position, the cam surface 44 is in a position such that body member 46 drops to its lowermost position in slot 50 as shown in solid outline in FIG. 2, from its uppermost position indicated in dashed outline in FIG. 2.

In the lower position shown in solid outline in FIG. 2, the switch actuating portion 54 of the member 46 is dropped to a position as illustrated in FIGS. 1 and 2 whereby the blade member 34 of switch 30 is self-biased downward to close the contact set 36 and maintain line power to the switches 18, 20 and the drum advance mechanism (not shown). In the condition shown in FIGS. 1 and 2, the detent means 60 is in a position shown in solid outline in its downward most position; and, the drum 14 is free to be rotated by any suitable advance mechanism.

Figure 3:
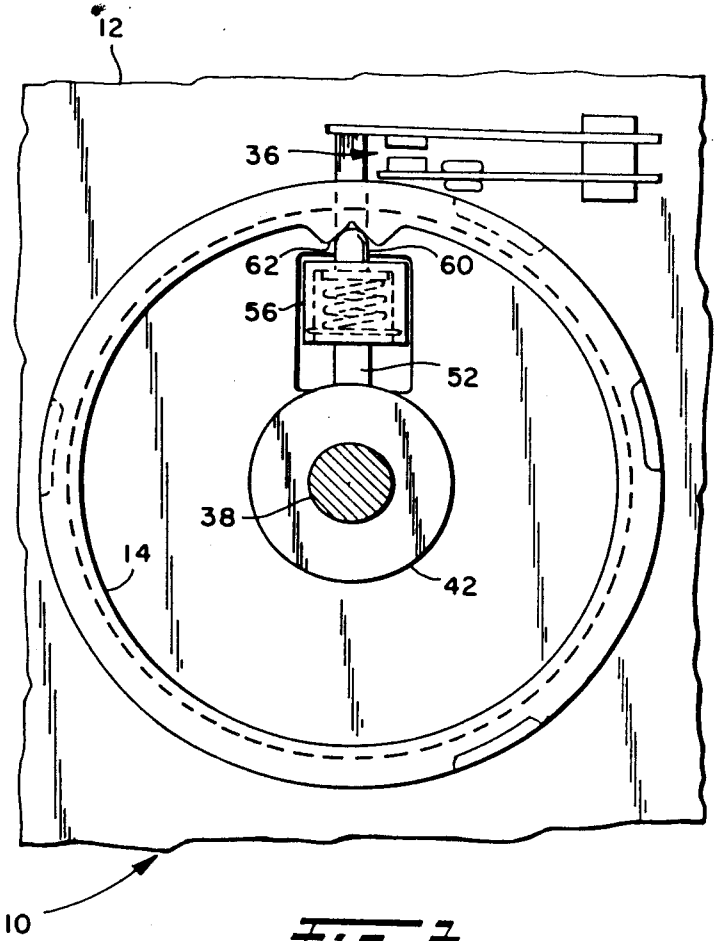
FIG. 3 is a view similar to FIG. 1 showing the detent mechanism engaged with the line power switch in the open position.
Figure 4:
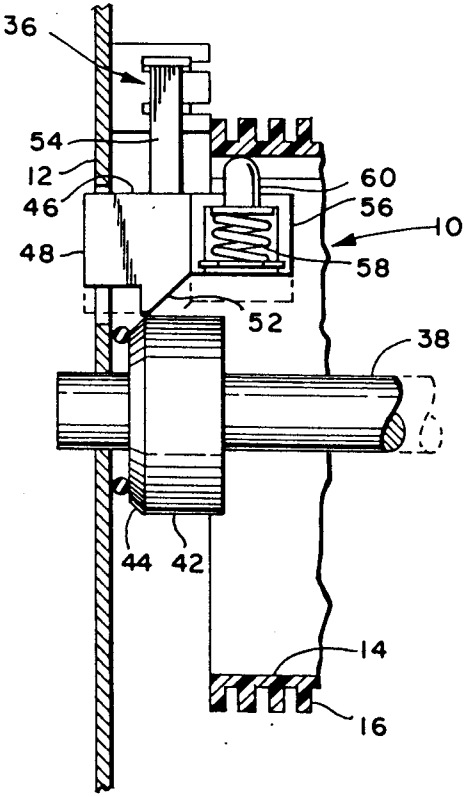
FIG. 4 a left end view of the structure illustrated in FIG. 3.

Referring to FIGS. 3 and 4, the shaft 38 is shown in solid outline as moved to its leftwardmost position as caused by the user movement of the shaft via a knob (not shown) to the leftwardmost or end position.

Drum 14 is shown as having a detent surface in the form of a notch 62 provided on the inner periphery thereof. In the position shown in solid outline in FIGS. 3 and 4, the slider member 46 has been moved upwardly by contact of cam surface 44 with the surface 52 such that actuator portion 54 has lifted contact blade 34 to the upward position breaking contact between the set of contacts 36.

In the upward position member 46 also raises the detent 60 to engage the notch 62 in the inner periphery of the drum 14. Engagement of detent 60 in notch 62 provides resistance to rotation and a positive indication of registration of the selected position of the drum 14 in the event that the user attempts to rotate the drum with the shaft in the position shown in FIG. 4.

The present invention thus provides an electromechanical programmer having a rotatable cam drum with tracks for actuating plural switches for controlling appliance functions An axially movable and , rotatable shaft, which may have a knob, is provided for user positioning of the cam drum for a selected program. Axial movement of the shaft causes a conically tapered cam to raise a slider for actuating and deactuating a line power switch series connected with the function switches and with the motorized cam advance mechanism. Raising of the slider causes a spring loaded detent pin to engage a notch in the inner periphery of the drum for providing increased resistance to cam rotation when the line power switch is in the OFF condition. When the knob is moved to a position allowing the slider to permit closing of the line power switch, the detent pin disengages from the cam drum permitting free rotation of the cam drum. The detent mechanism is thus operable in the appliance "OFF" condition to give the user a tactile sense of the selected position of the cam drum.

The present invention thus provides a detent action for selected cam drum positions, but does not require the cam drum advance mechanism to drive thru or overcome the detent.

Although the invention has hereinabove been described with respect to the illustrated embodiments, it will be understood that modifications and variations scope of the following claims.

I claim:

1. A combination line switch and cam position indicator assembly for an electromechanical programmer comprising:

(a) a cam drum rotatably mounted on a base means having at least one program cam track provided thereon, said drum adapted for motorized advancement;

(b) at least one program function switch disposed for actuation by said cam track;

(c) means defining a detent surface on said cam drum;

(d) a line switch adapted for series connection with an advancement motor for said cam, said switch having a stationary blade and a movable blade operable upon movement to break and make a set of contacts adapted for connection to to said motor;

(e) a shaft rotatably disposed on said base means movable axially between a first and second position, said shaft in said second position operable upon user rotation to effect rotation of said cam drum to any of a plurality of selected positions;

(f) a switch cam means associated with said shaft and movable therewith;

(g) switch actuator means disposed for contact with said switch cam means and movement with respect to said cam drum between a first and second position, said actuator means operable in said first position to move said movable switch blade for breaking said contact set and, said actuator means operable in said second position to permit said movable switch blade to close said contact set; and (h) detent means operable to engage said detent second position and operably disengaged when said actuator means is in said first position.

2. The assembly defined in claim 1 wherein said switch actuator means includes means resiliently engaging said detent surface.

3. The assembly defined in claim 1 wherein said switch cam means comprises an annular tapered surface.

4. The assembly defined in claim 1 wherein said switch actuator means includes a spring biased pin for engaging said detent surface.

5. The assembly defined in claim 1 wherein said shaft in said first position free rotating with respect to said cam drum.

6. The assembly defined in claim 1 wherein said cam drum has at least one cam track formed on the outer periphery thereof and said detent formed on the inner periphery thereof.

7. The assembly defined in claim 1 wherein said switch actuator means has portions thereof guided for said movement in a slot formed in said base means.

8. The assembly defined in claim 1 wherein said switch actuator means has a switch follower means integrally formed therewith.

9. The assembly defined in claim 1 wherein said detent surface comprises a uniquely configured surface formed on the inner periphery of said cam drum and said detent means comprises a spring biased pin carried with said switch actuator means.

10. An electromechanical programmable assembly comprising:

(a) housing means having cam drum means rotatably mounted thereon and adapted for rotary advancement by a motorized drive means, said cam drum means having at least one peripheral cam track and a detent surface provided thereon;

(b) program switch means disposed on said housing means and operative in response to advancement of said cam track for sequentially making and breaking a first set of electrical contacts for control of a program function;

(c) a line switch having a movable blade for making and breaking a second set of electrical contacts adapted for controlling a motorized advance for said cam drum means and said program switch means;

(d) a shaft means mounted for rotary and axial movement on said housing means;

(e) switch cam means operable upon axial movement of said shaft means to effect movement of said movable blade for closing and breaking said second set of contacts; and, (f) detent means disposed for movement on said housing means operable, upon said movement of said switch cam means for breaking said second set of contacts, to engage said detent surface, said detent means operable, upon said movement of said switch cam means for closing said first set of contacts, to disengage said detent surface.

11. The programmer assembly defined in claim 10, wherein said switch cam means includes an annular tapered surface on said shaft means having a slider member contacting said tapered surface for movement thereby.

12. The programmer assembly defined in claim 10 wherein said switch cam means includes an axially inclined surface on said shaft means with a slider member contacting said inclined surface for movement thereby; and said slider member has said detent means thereon.

13. The programmer assembly defined in claim 10 wherein said switch cam means includes an axially inclined surface on said shaft with a sliding member guided for sliding movement on said base means in response to movement of said inclined surface; and, said detent means is mounted on said sliding member.

14. The programmer assembly defined in claim 13 wherein said axially inclined surface comprises an annular tapered surface.

* * * * *